US011732533B2

(12) United States Patent
Williams

(10) Patent No.: US 11,732,533 B2
(45) Date of Patent: Aug. 22, 2023

(54) MODULAR DRILLING APPARATUS AND GROUND TREATMENT METHODS

(71) Applicant: Joseph Alexander Williams, Belington, WV (US)

(72) Inventor: Joseph Alexander Williams, Belington, WV (US)

( * ) Notice: Subject to any disclaimer, the term of this patent is extended or adjusted under 35 U.S.C. 154(b) by 127 days.

(21) Appl. No.: 17/483,480

(22) Filed: Sep. 23, 2021

(65) Prior Publication Data

US 2022/0090451 A1 Mar. 24, 2022

Related U.S. Application Data

(60) Provisional application No. 63/081,931, filed on Sep. 23, 2020.

(51) Int. Cl.

| | |
|---|---|
| ***E21B 7/00*** | (2006.01) |
| ***E21B 7/02*** | (2006.01) |
| ***E21B 15/00*** | (2006.01) |
| ***E04H 12/18*** | (2006.01) |
| *E04H 12/34* | (2006.01) |

(52) U.S. Cl.

CPC ..... *E21B 15/003* (2013.01); *E04H 12/187* (2013.01); *E21B 7/002* (2013.01); *E21B 7/02* (2013.01); *E04H 12/345* (2013.01)

(58) Field of Classification Search

CPC . E21B 7/001; E21B 7/02; E21B 7/002; E21C 25/06; E21C 25/52

See application file for complete search history.

(56) References Cited

U.S. PATENT DOCUMENTS 1,482,396 A * 2/1924 Hansen ..... E21B 15/003 173/52

FOREIGN PATENT DOCUMENTS

| | | | | |
|---|---|---|---|---|
| CN | 102561944 A | * | 7/2012 | ..... E02D 5/34 |
| FR | 2491519 A | * | 4/1982 | ..... E02F 5/02 |
| JP | 3032133 B2 | * | 4/2000 | |

* cited by examiner

*Primary Examiner* — Giovanna Wright
(74) *Attorney, Agent, or Firm* — Dinsmore & Shohl LLP; Monika L. Jaensson

(57) ABSTRACT

Provided is a novel drilling apparatus for drilling into prepared ground surfaces and natural ground conditions. The apparatus includes a mast assembly, a support structure assembly flexibly coupled with the mast assembly, a plurality of drill assemblies affixed to the support structure assembly, and a frame. Also provided is a method of drilling into a ground surface, by providing a drilling apparatus having a mast assembly, a support structure assembly flexibly coupled with the mast assembly, a plurality of drill assemblies affixed to the support structure assembly, and a frame. Each of the drill assemblies include a hollow drill rod with a drill bit at one end, the bit having exterior cutting elements and interior fluid diverters. Pressurized fluid and torque is supplied to the drill rods, and by means of the mast assembly and support structure assembly the drill rods are moved downward so that using the downward and rotational force, and the pressurized fluid, the drill bits drill into the ground surface.

20 Claims, 7 Drawing Sheets

MODULAR DRILLING APPARATUS AND GROUND TREATMENT METHODS

BACKGROUND

The disclosed technology regards a modular drilling apparatus and ground treatment methods useful in a multitude of applications concerning prepared ground surfaces and natural ground conditions.

Traditionally, drilling through asphalt, concrete, or rock is an expensive, slow and laborious process, which significantly degrades machinery. Specifically, present drilling systems use a single drill rod and bit, drilling one hole at a time. Often these systems use air as a drilling propellant, thereby generating significant dust at the worksite and causing the machinery to become exceedingly hot, damaging the drilling rod and bit. Known drilling systems of the prior art are large, heavy, and expensive, and in operation require an inefficient use of human resources.

Present soil conditioning systems drive hollow rods into the ground, injecting water and additives to condition the soil. These rods do not rotate or drill into the surface; rather they use force to drive the rods into the surface. Further, these systems are permanently affixed to bulldozers, and due to the weight of this vehicular machinery and the design of the injection systems, the injection systems themselves must provide a heavy counterweight to the bulldozer to drive the rods into the ground.

Therefore, there is a need to provide a drilling apparatus that can drill multiple holes into the ground surface at the same time and also efficiently use and inject water and additives into the strata. Such a drilling apparatus should minimize the generation of dust at the worksite, the operational heat of the machinery, and necessary human resources.

The disclosed technology overcomes the deficiencies in the prior art and addresses these and other needs by providing a modular apparatus having four hollow drill rods which quickly and efficiently drill into the earth and present pressurized water and additives to ground strata. The apparatus is lightweight, and may be coupled with and decoupled from a skid steer or other machinery (e.g., excavators, dozers and trucks) and transported by a pickup truck to another work site. By its novel design, operation of the apparatus requires limited personnel, maximizing safety and decreasing operational costs. Further, with the use of fluid as a propellant, dust at the worksite is minimized, the apparatus operates with lower heat and less wear on drill rods and bits, and generates smoother holes in the earth.

The disclosed technology is useful in innumerable applications, including for example for: excavation; installing drainage controls, irrigation canals and levee securements; slip repairs and the installation of soil nails to hold hill sides; breaking up overburden, permafrost, frozen ground, coal, and rock; injecting soil treatments into contaminated or unstable soil; injecting grout for sealing or raising building foundations; injecting gel or epoxy for securing steel to rock beds; applying pest control agents in difficult to reach places; applying gel for sealing fishers or leaks in ponds and levees; and breaking through fragipans. In one particular application, the additive may be a soil stabilizing fluid which reduces the overall swell potential of clay based soils, sufficiently increasing the ground compression strength to support buildings, roadways and other construction.

GENERAL DESCRIPTION

The disclosed technology provides a novel drilling apparatus for drilling into prepared ground surfaces and natural ground conditions. Generally, the apparatus includes a mast assembly, a support structure assembly flexibly coupled with the mast assembly, a plurality of drill assemblies affixed to the support structure assembly, and a frame.

The mast assembly includes a top mast beam and a pair of hydraulic cylinders, with the hydraulic cylinders being affixed at a first end to the top mast beam and at a second end to the frame such that the mast assembly is raised and lowered relative to the frame through the extension and retraction of the hydraulic cylinders. The support structure assembly flexibly coupled to the mast assembly includes a top support beam and a mid support beam; the flexible coupling allows the support structure assembly to move vertically with the mast assembly. The frame supports the mast assembly and includes a top horizontal frame beam, a pair of vertical frame beams, and a base beam. Each of the top horizontal frame beam and the base beam are affixed to the vertical frame beams, and a universal skid steer coupler is secured to the rear of the frame.

The plurality of drill assemblies affixed to the support structure assembly of the disclosed technology each include a gearbox secured to a first facing side of the top support beam, a hydraulic power take off (PTO) coupled with and secured to the corresponding gearbox such that an output gear of the PTO supplies torque to the gearbox with the gearbox amplifying the torque, and a hollow drill rod with a drill bit at one end and secured at the other end to the corresponding gearbox to receive the amplified torque and pressurized fluid from the gearbox. Each drill rod is vertically supported by aligned apertures in the mid support beam and the base beam, and the drill bit includes exterior cutting elements and interior fluid diverters.

Several separate hosing systems are provided, including a first hosing system for supplying pressurized hydraulic fluid to the hydraulic cylinders; a second hosing system to provide pressurized hydraulic fluid to each PTO of the drill assemblies; and a third hosing system for supplying pressurized water with or without additives to each of the drill assemblies.

In some embodiments the apparatus includes one or more flow dividers provided with one or more of the hosing systems to divert fluid flow to each of the drill assemblies or the hydraulic cylinders, as applicable. In one such flow divider providing pressurized hydraulic fluid to each PTO, the divider allocates differing volumes of pressurized hydraulic fluid among the drill assemblies as each corresponding drill rod encounters different soil compaction or conditions, thereby directly affecting the torque supplied to each of the drill rods, resulting in equalized shaft bore rates among the drill rods.

As herein described, the top beam of the support structure assembly is flexibly coupled with the mast assembly, intending that the beam is not rigidly affixed to the mast assembly or the frame, but rather being capable of angling away from its natural position of horizontal to a ground surface to accommodate varying bore rates among the drill rods in operation. In an embodiment, this flexible coupling is accomplished through a pair of chains affixed at opposing ends to the top support beam and the frame, respectively, being supported about a top sprocket gear affixed to the mast assembly. Offering the same flexibility, the mid support beam may likewise be coupled with the top support beam by chains, affixed at one end to the top support beam, at another end to the frame, and being supported about a mid sprocket gear affixed to the mid support beam.

The disclosed technology further provides a method of drilling into a ground surface, by providing a drilling apparatus having a mast assembly, a support structure assembly flexibly coupled with the mast assembly, a plurality of drill assemblies affixed to the support structure assembly, and a frame. Each of the drill assemblies include a hollow drill rod with a drill bit at one end, the bit having exterior cutting elements and interior fluid diverters. Pressurized fluid and torque is supplied to the drill rods, and by means of the mast assembly and support structure assembly the drill rods are moved downward so that using the downward force and rotation of the bits as well as the pressurized fluid, the drill rods drill into the ground surface.

The pressurized fluid supplied to the drill rods includes water and from time to time an additive. The flexible coupling of the top and mid support beams as herein disclosed greatly enhances this drilling method.

The apparatus of the disclosed technology is intended to be removably coupled with a skid steer or similar vehicle, and the method of drilling is similarly well suited to the use of such vehicles. These and other novel attributes of the apparatus and methods of the disclosed technology are provided through embodiments shown and described below.

FIGURES

DETAILED DESCRIPTION OF EMBODIMENTS

Figure 1:
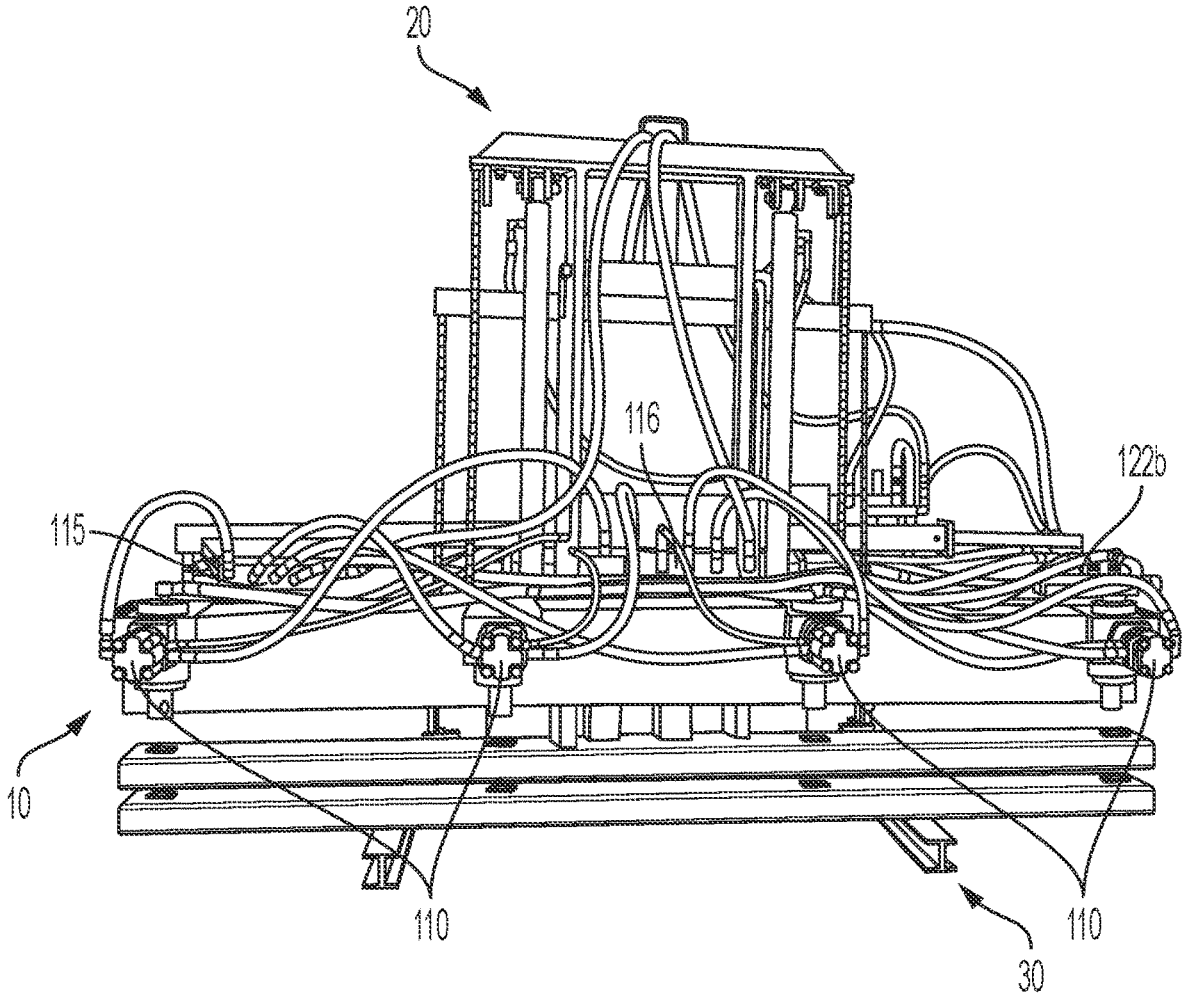
FIG. 1 is a front view of an embodiment of the apparatus of the disclosed technology.
Figure 2:
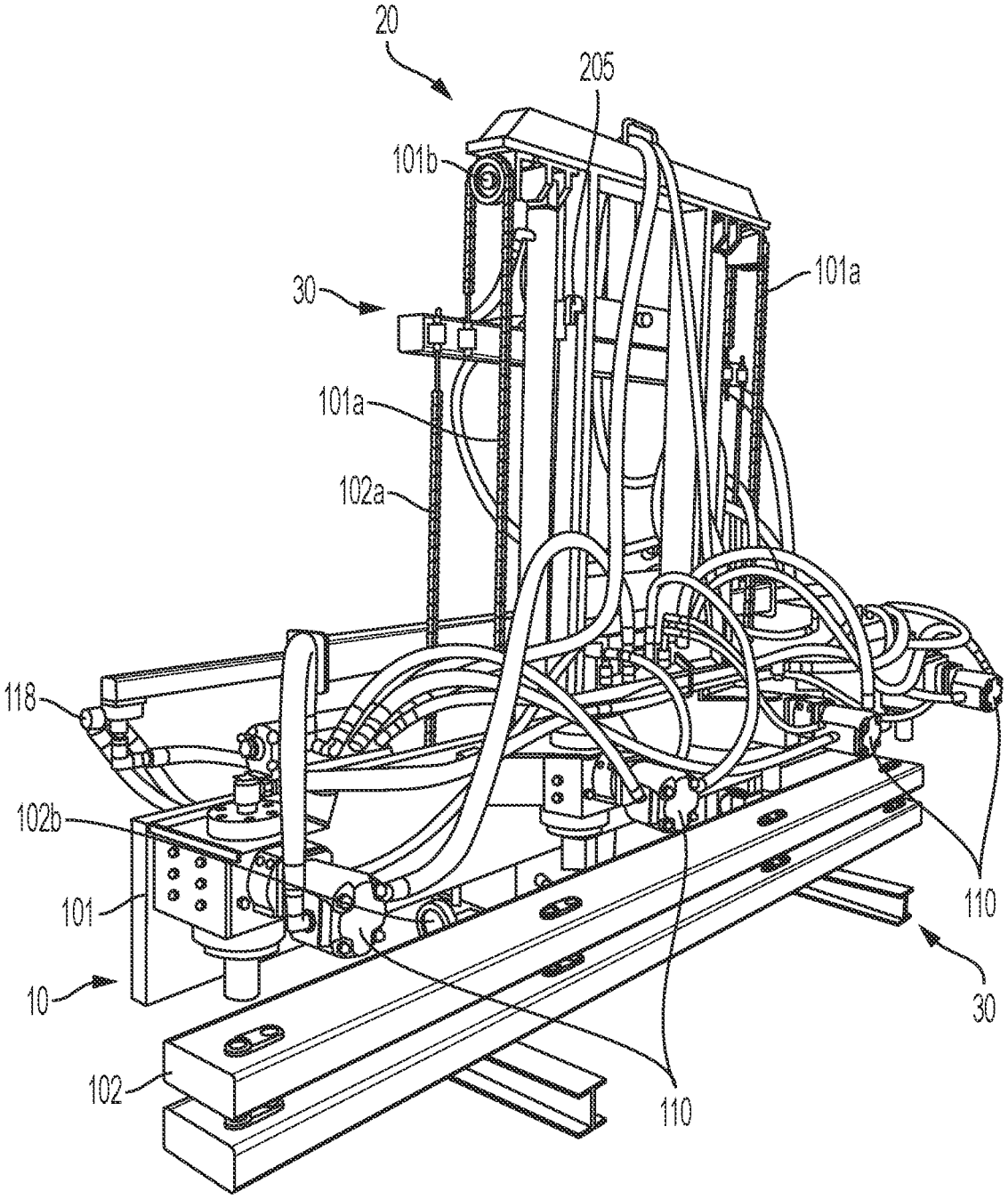
FIG. 2 is a perspective view of the embodiment of FIG. 1.
Figure 3:
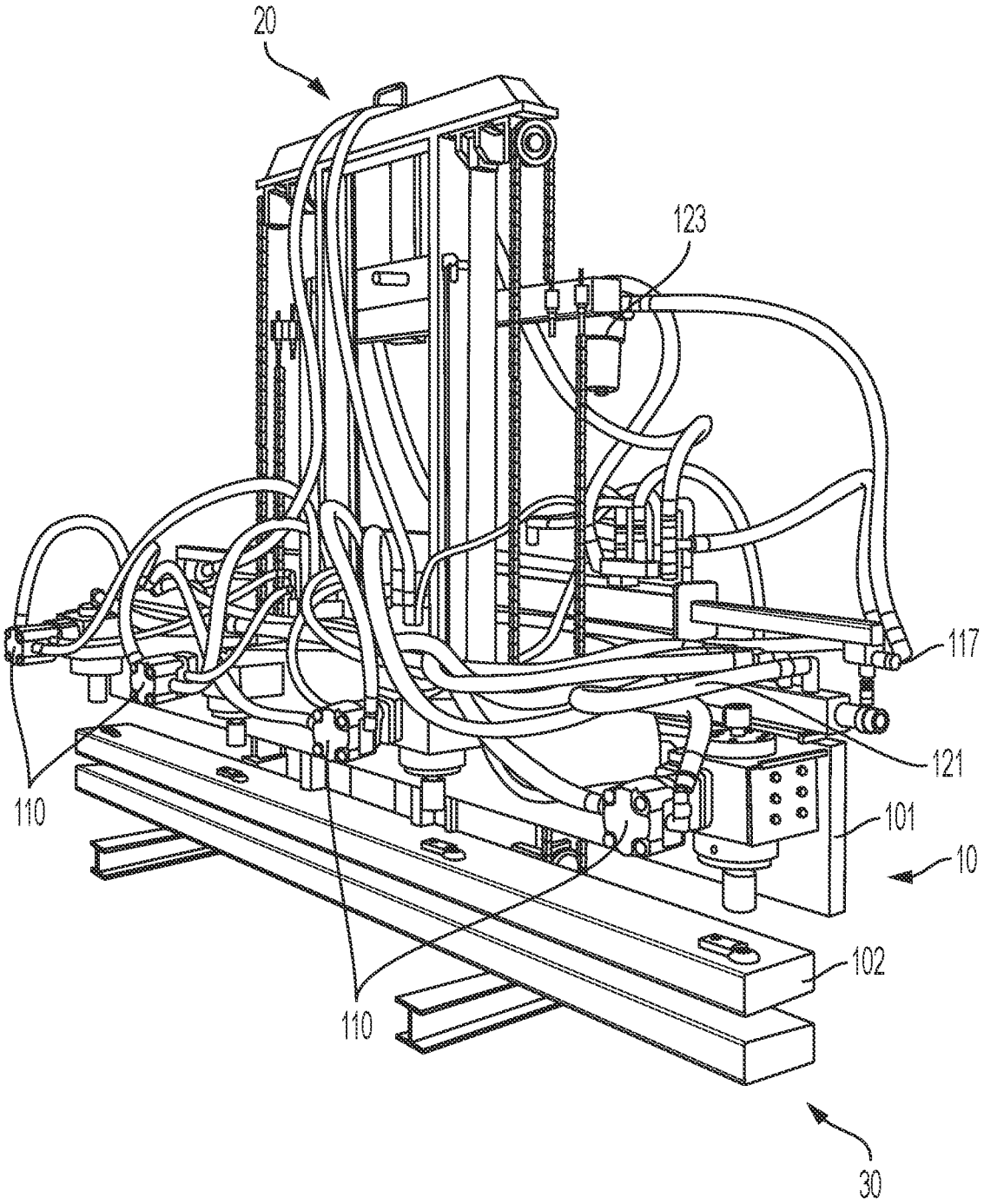
FIG. 3 is another perspective view of the embodiment of FIG. 1.

As shown in FIGS. 1-7, embodiments of the disclosed technology include: a support structure assembly 10 which supports a plurality of drill assemblies 110, the support structure assembly being coupled with a mast assembly 20 which is supported by a frame 30. In operation the mast assembly and the support structure assembly move together vertically relative to the frame. Each of the drill assemblies 110 includes a hollow drill rod 111 with a drill bit 111*a* that both physically bores into the earth through rotation of the bit, and provides pressurized water to facilitate drilling efficiency. When desirable and based upon soil conditions, soil stabilizing fluids and/or other additives are provided with the pressurized water for strategic penetration into the earth strata.

The support structure assembly 10 comprises in parallel configuration a top support beam 101 and a mid support beam 102. The top support beam is flexibly coupled with the mast assembly by means of a pair of chains 101*a* (or similar strong, durable and flexible material), wherein each chain is affixed at one end to the top support beam (e.g., on the rear of the beam), is supported about a top sprocket gear 101*b* affixed to the mast assembly, and is affixed at a second end to the frame. By this configuration and as the top support beam is not rigidly affixed to the mast assembly or the frame (except through the chain coupling described), the top support beam moves vertically with the mast assembly, positioned with its length generally horizontal to the ground although capable of angling away from such horizontal position to accommodate varying bore rates among the drill rods. Such varying bore rates may be experienced as a result of different soil compaction, rock or other conditions as may be independently encountered by each of the drill rods.

Similarly, the mid support beam 102 is flexibly coupled with the top support beam 101 by means of a pair of chains 102*a* (or similar strong, durable and flexible material), wherein each chain is affixed at one end to the top support beam 101 (e.g., on the rear of the beam), is supported about a mid sprocket gear 102*b* affixed to the mid support beam, and is affixed at a second end to the frame 30. By this configuration, the mid support beam moves vertically with the mast assembly and the top support beam (except when the mid support beam is resting atop a base beam, as hereinafter described), with flexibility similar to the top support beam hereinabove described as relates to its position relative to horizontal, thereby accommodating varying bore rates among the drill rods.

Figure 6:
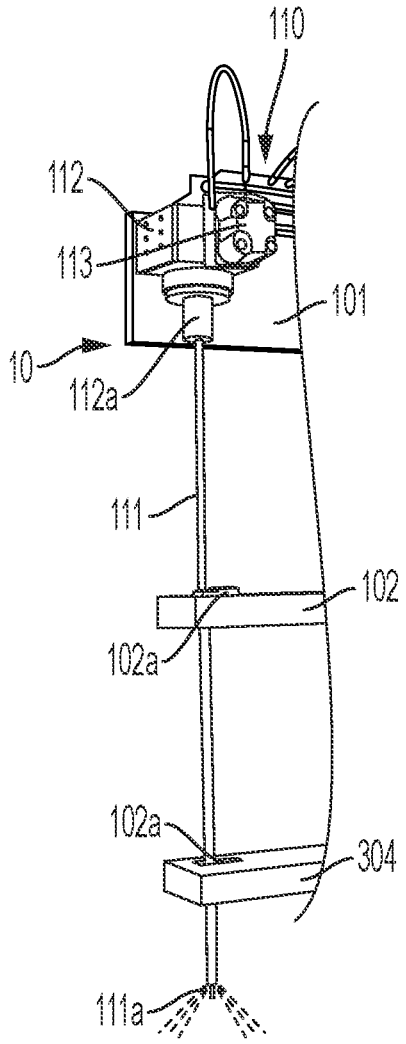
FIG. 6 is a perspective view of an embodiment of a drill assembly of the disclosed technology.

As shown in FIG. 6 among others, affixed to the first facing side of the top support beam 101 are a plurality of drill assemblies 110, each drill assembly comprising: one hollow drill rod 111, a gearbox 112 and a hydraulic power take off (PTO) 113. Each PTO 113 is coupled with and secured to a gearbox 112, wherein the PTO output gear supplies torque to the gearbox, which amplifies the torque and provides the rotational power to the drill rod 111 removably secured within a cylinder 112*a* of the gearbox. The gearboxes 112 of the drill assemblies 110 are secured along the side of the top support beam 101 (by means of bolts or other securing devices, and/or welding). Suitable gearboxes include an input gear coupled with the output gear of the PTO, and a plurality of other gears to increase the torque supplied to a drill rod secured within a hollow cylinder affixed to one of such other gears. The gearboxes further comprise a hollow tube aligned with the hollow cylinder to deliver pressurized water (and additives) to the core of the drill rod. The drill rods 111 are vertically supported by aligned apertures 102A in the mid support beam 102 and the base beam 304 hereinafter described; the apertures may comprise bushings to further support and protect the drill rods. In embodiments of the disclosed technology, the drill rods may be 1½" diameter with a length of about 1½'-12', although the apparatus could be designed for shorter or longer drill rods. The figures depict drill rods of 10'; if 16' drill rods are intended, the base beam 304 may include another beam flexibly coupled with the base beam and having drill apertures aligned with those of the base beam so that during drilling the additional beam may be received within a hollow portion of the base beam, providing additional guidance to the longer drill rods at early stages of a deep drill.

Figure 5:
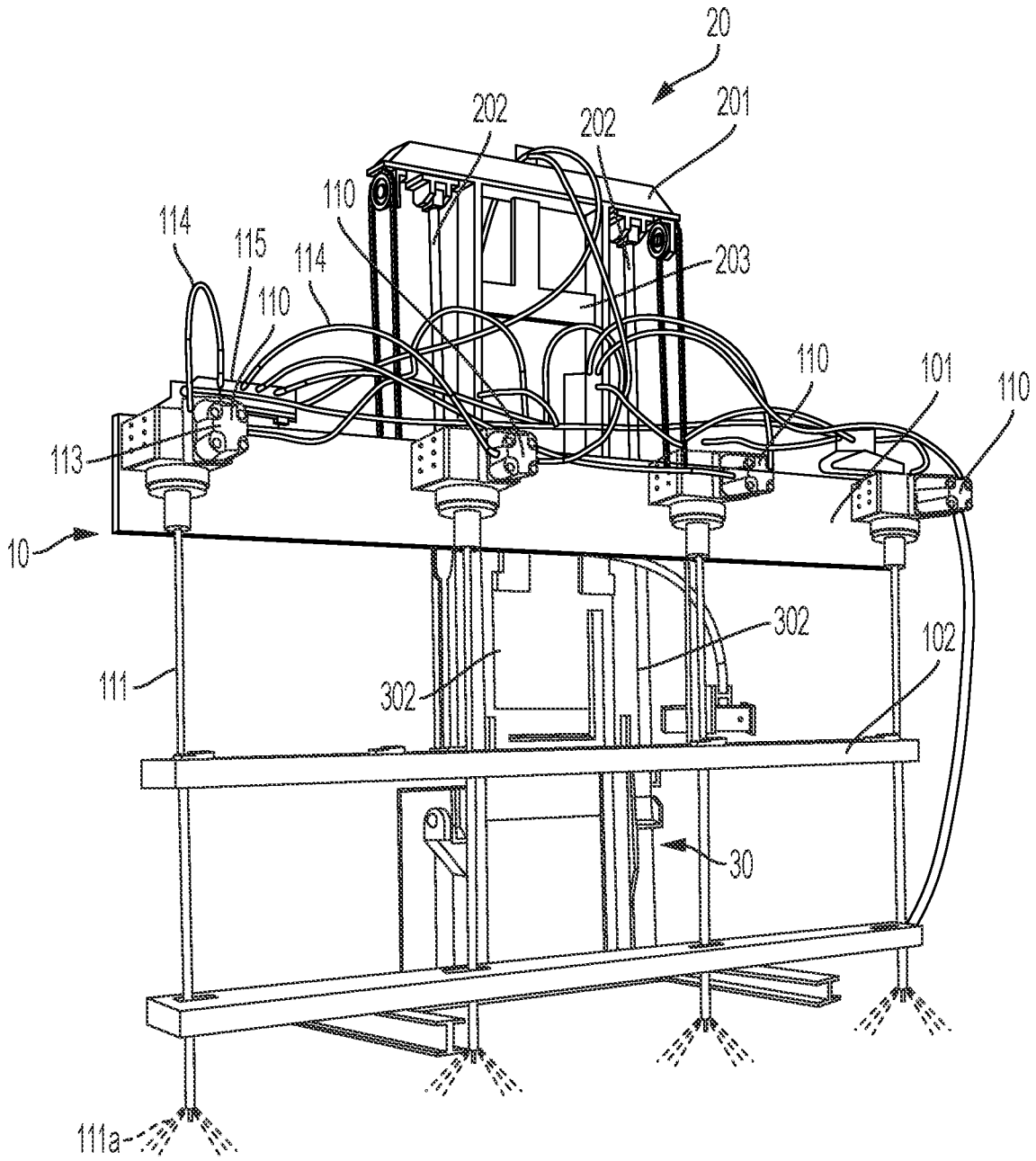
FIG. 5 is a perspective view of the embodiment of FIG. 1, in operation.

Pressurized hydraulic fluid is supplied through flexible hosing 114 to each PTO 113 of the drill assemblies 110 and the hydraulic cylinders 202, originating from a hydraulic pump provided on the skid steer or otherwise at the site, wherein the hydraulic fluid supplied to the hydraulic cylinders is supplied to the cylinders by means of a hydraulic distribution block 115*a*. As shown in FIG. 5 and other figures, in embodiments of the disclosed technology a hydraulic flow divider 115 may be secured to the top support beam 101 to receive some of the pressurized hydraulic fluid from the pump at input port, and divert it to each of the PTOs 113. These dividers may allocate differing volumes of pressurized hydraulic fluid among the drill assemblies 110 as each corresponding drill rod 111 encounters different soil compaction or conditions, thereby directly affecting the torque supplied to each of the drill rods, resulting in equalized shaft bore rates. For safety purposes, nylon covers may be crimped over these and other hydraulic hoses of the apparatus of the disclosed technology to contain the hoses under high pressure in the event of a burst. As shown in FIG. 5 and other figures, in these and other embodiments of the disclosed technology hydraulic fluid exits each of the PTOs 113 and may aggregate for return to the pump through a return manifold 116, also secured to the top support beam 101.

While the flow of hydraulic fluid is primarily controlled through operation of the pump and the hydraulic flow divider, one or more knobs, buttons or switches 117 may be affixed to one or both sides of the top support beam 101 (or elsewhere on the assemblies of the disclosed technology), the knobs or buttons being in communication with the hydraulic flow divider to cause the divider to reroute the flow of hydraulic fluid to the pump when the knob/button/switch is engaged. Hydraulic fluid used in the system may be filtered by means of a filtering system 123 provided on the mast or elsewhere.

Figure 4:
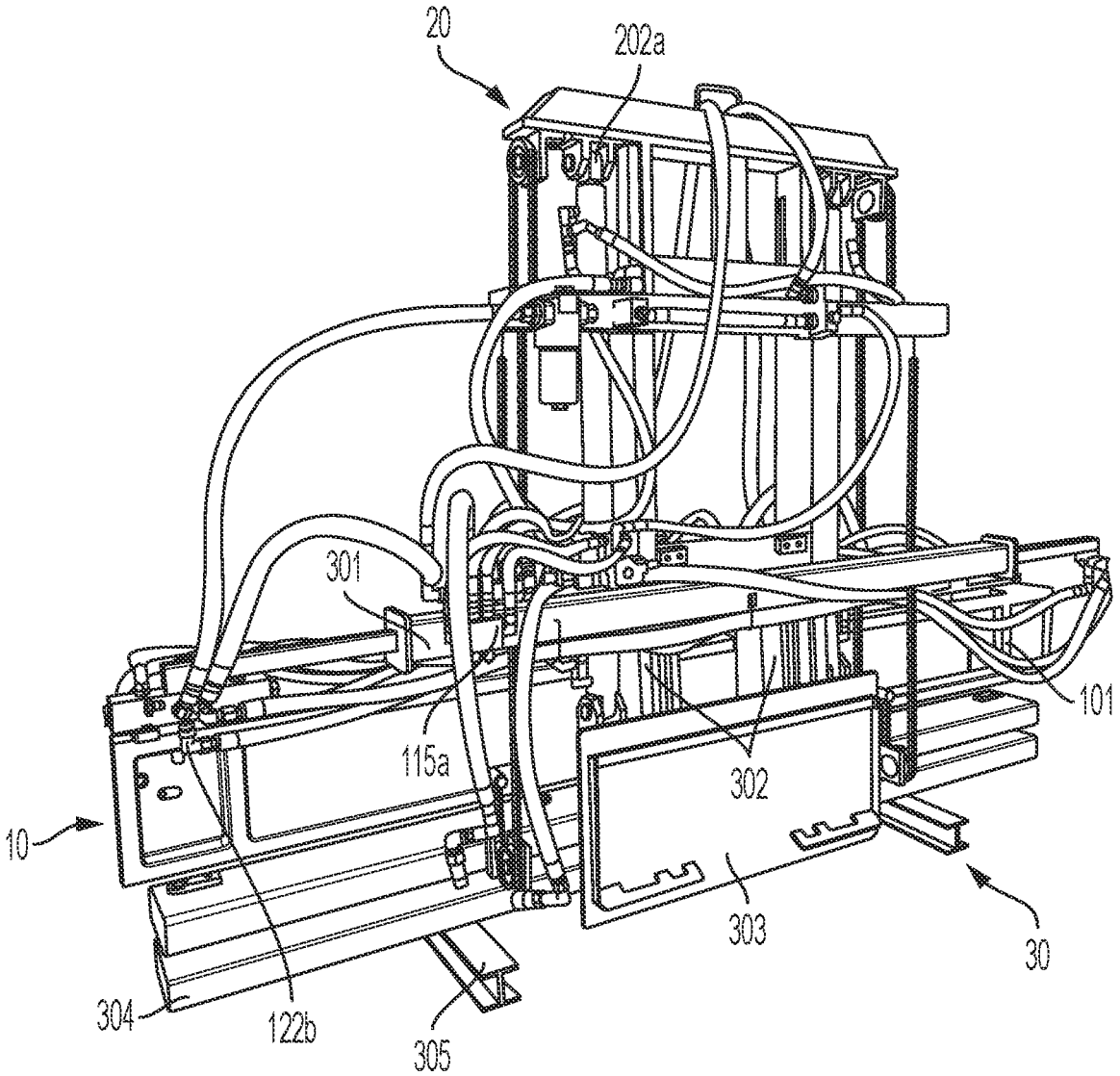
FIG. 4 is a back view of the embodiment of FIG. 1.

A pressure regulator 118 may be coupled between the pressurized fluid source and the hydraulic flow divider to allocate the pressure of the hydraulic fluid delivered to the divider and that delivered to the hydraulic cylinders, thereby controlling the maximum torque applied to the drill rods 111 (and the hydraulic cylinders). As shown in FIG. 4, this regulator may be affixed to the mast assembly 20.

Pressurized water is supplied by means of another pump to each drill assembly 110 at the gearbox 120, by means of hosing 121, and then sprayed into the earth by means of the rotating drill rods 111 and the interior fluid dividers of the drill bits 111*a*. In embodiments of the disclosed technology, an input port and another hydraulic flow divider 122*b* may be affixed to the top support beam 101 or otherwise on the apparatus of the disclosed technology to receive the pressurized water (and added additives, from time to time) from the pump, and divert it to each of the drill assemblies, providing pressurized water through each of the drill rods at an operating pressure of about 300 psi, handling about 100 gpm flow rate of water.

Soil stabilizing fluid or other specialized formulations for soil conditioning as may be necessary or desirable at the treated earth may likewise be mixed with the water and delivered to each gearbox 120. Likewise, other additives may be supplied to the drill assemblies such as grout for sealing or raising building foundations, gel or epoxy for securing steel to rock beds or for sealing fishers or leaks in ponds and levees, and pest control agents. Soil stabilizers and other additives can be corrosive, and therefore the components of the drill assemblies 110 and the flow divider 122B may be constructed out of chromium-molybdenum steel or other materials resistant to acidic corrosion.

By the afore-described configuration, the supplied amplified torque cause the hollow drill rods 111 to bore or drill into the earth and deliver pressurized water (and additives when desired) at and below the earth surface. The fluids may be delivered consistently or intermittently, as controlled for example at the source pumps.

Figure 7:
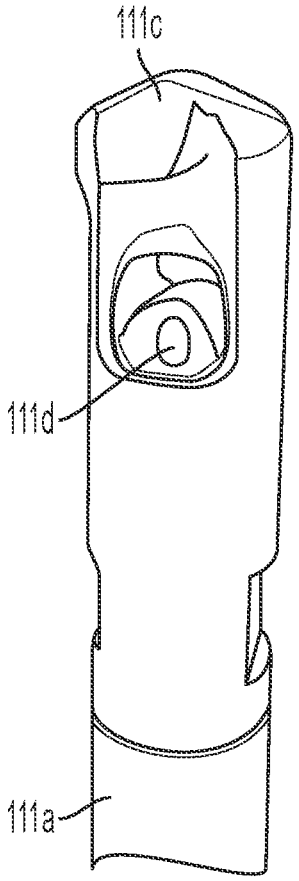
FIG. 7 is a view of an embodiment of the drill bit of the disclosed technology.

As herein described, the drill rod is hollow to facilitate the delivery of fluids into the earth. As shown in FIG. 7, a drill bit 111*a* is affixed to or integral with the end of the drill rod, and includes exterior cutting elements 111*c* as well as fluid diverters 111*d* causing the pressurized fluid to spray out of at least two opposing sides of the drill bit at an angle of between about 20-40 degrees from the drill bit's vertical axis.

In the embodiment shown, the drill assemblies 110 are affixed to the top support beam 101 such that the drill rods 111 are positioned about 40-50", or 44" apart. When operating with ideal water pressure (300 psi), in this configuration the circumference of the resulting spray overlaps between each of the drill rods, thereby fully saturating and achieving full stabilization of the earth at multiple bore depths.

Referring to FIGS. 1 and 5, vertical movement of the support structure assembly (and the drill assemblies 110 affixed thereto) is provided by the mast assembly 20, which includes a top mast beam 201 and a pair of hydraulic cylinders 202. The mast assembly may further include one or more lateral and vertical beams or structures 203 to support and strengthen the assembly.

In the embodiment shown, one end of the hydraulic cylinders are affixed respectively to the top mast beam by means of a rotating bushing 202*a*, while the other end of the hydraulic cylinders are affixed respectively to the frame. Pressurized hydraulic fluid is supplied to the hydraulic cylinders through flexible hosing from a hydraulic pump provided on the skid steer or otherwise at the site, and may be the same hydraulic pump (with a diverter) as the pump for the PTOs hereinabove described. Thereby, the vertical position of the mast assembly relative to the frame is controlled through extension and retraction of the hydraulic cylinders. As hereinabove described, top sprocket gears 101*b* are supported on each side of the mast assembly to couple the assembly with the support structure assembly, and by this configuration the mast assembly and the support structure assembly move vertically together in relation to the frame, and force downward movement of the mast assembly causing the torqued drill rods to rotationally bore or drill into the earth.

In the embodiment shown, one or more guide wheels 205 are provided on the vertical frame beams to prevent the mast from torqueing from side to side.

The mast assembly is supported by the frame 30. As shown in FIGS. 1 and 4, the frame includes a top horizontal frame beam 301, and a pair of vertical frame beams 302, wherein the vertical frame beams of the mast assembly are slidably engaged with the vertical beams of the mast assembly. Affixed to the rear of the frame is a universal skid steer coupler 303, which allows the unit to be coupled with and decoupled from a skid steer, an excavator, a bulldozer, and other similar vehicular machinery. The frame further comprises a base beam 304 affixed to the bottom of the vertical frame beams, and aligned with the top and mid support beams of the support structure assembly, having apertures aligned to receive the drill rods. The base beam 304 may include a pair of feet 305 affixed to the underside thereof to stabilize the unit in operation, and allow the unit to be transported by means of a fork lift, and on vehicles that accommodate such a design. Retractable feet (not shown) may likewise be affixed to the base beam to accommodate longer drill rods, as hereinabove discussed.

Supply of hydraulic fluid to each of the PTOs and the hydraulic cylinders, can be controlled at a remote location, such as on the skid steer, by coupling the elements thereof to the control system on the skid steer by mean of a seven pin connector, for example, thereby allowing control of the apparatus at the skid steer.

An apparatus of the disclosed technology may be 12' wide×8' tall×3' deep, and weighs less than 4,000 lbs.

In an embodiment of the operation of the disclosed technology, the apparatus is coupled with the skid steer, which lifts the apparatus (at the coupling with the frame) off of the ground and moves it to the ground area of interest. With the mast assembly raised (by means of the hydraulic cylinders), hydraulic power is then supplied to the drilling assemblies. As the mast assembly and the coupled support structure assembly move vertically down relative to the frame, the drill rods of the drilling assemblies approach and bore into the ground surface. Pressurized water is provided through the drill rods and bits to facilitate drilling; consistently or intermittently additive can be supplied with the pressurized water to achieve saturation. In many applications the drill rods bore a certain distance into the ground, e.g. 1', and continue to rotate without further vertical movement to ensure full saturation at a certain bore depth; then continue deeper, halt for saturation, and the process is repeated. Once the intended drilling depth is achieved, the rods are withdrawn from the soil and the apparatus is moved a distance further, e.g. 4', into the treatment site area.

By means of the present apparatus, soil can be treated 4', 8' or even 12' or even 16' under the ground surface. The apparatus is capable of drilling through soil, rock, gravel, asphalt, concrete, and stone, and injecting high pressurized fluids into the subsurface of the ground. As an exemplary application, when used on concrete or other solid surfaces the drill grid pattern may be 1½" holes 4' apart, which efficiently and economically provides ideal conditions for an excavator to rip out the solid surface.

Further provided by the disclosed technology are methods of treating ground surfaces. The ground surface may be asphalt, concrete, or rock, other natural or man-made conditions, and soil, including contaminated or unstable soil. In these methods, an apparatus is provided such as but not limited to the embodiments of the apparatus hereinabove described. The apparatus performs the method by (a) simultaneously rotating and applying vertical pressure to a plurality of drill rods, each rod including a drill bit, so that the rods bore into the ground surface; (b) while the drill rods bore into the ground surface, supplying pressurized water through the drill rods and at an angle from the drill bits, the water being supplied alone, with an additive, or intermittently with an additive.

In view of the embodiments described above, it should be apparent to those skilled in the art that the present invention may, be embodied in forms other than those specifically described herein without departing from the spirit or central characteristics of the invention. Thus, the specific embodiments described herein are to be considered as illustrative and by no means restrictive.

The above description is that of a preferred embodiment of the invention. Multiple modifications and variations are possible in light of the above teachings. It is therefore to be understood that, within the scope of the appended claims, the invention may be practiced otherwise than as specifically described. Any reference to claim elements in the singular, e.g. using the articles "a," "an," "the," or "said" is not construed as limiting the element to the singular.

Further, it is to be understood that the present invention is not limited to the embodiments described above, but encompasses any and all embodiments within the scope of the preceding claims. None of the above inventions and patents, taken either singly or in combination, is seen to describe the instant invention as claimed.

The invention claimed is:

1. A drilling apparatus comprising a mast assembly, a support structure assembly flexibly coupled with the mast assembly, a plurality of drill assemblies affixed to the support structure assembly, and a frame, wherein the mast assembly comprises a top mast beam and a pair of hydraulic cylinders, the hydraulic cylinders being affixed at a first end to the top mast beam and at a second end to the frame such that the mast assembly is raised and lowered relative to the frame through the extension and retraction of the hydraulic cylinders;

wherein the support structure assembly comprises a top support beam and a mid support beam, and wherein the support structure assembly is flexibly coupled with the mast assembly such that the support structure assembly moves vertically with the mast assembly;

wherein the frame supports the mast assembly and comprises a top horizontal frame beam, a pair of vertical frame beams, and a base beam, wherein each of the top horizontal frame beam and the base beam are affixed to the vertical frame beams, and where the frame further comprises a universal skid steer coupler secured to a rear side of the frame;

wherein each of the plurality of drill assemblies comprises:

a gearbox secured to a first facing side of the top support beam, a hydraulic power take off (PTO) coupled with and secured to the gearbox such that an output gear of the PTO supplies torque to said gearbox and said gearbox amplifies the supplied torque, and a hollow drill rod with a drill bit at one end and secured at the other end to the corresponding gearbox to receive amplified torque and pressurized fluid from the gearbox, wherein each drill rod is vertically supported by aligned apertures in the mid support beam and the base beam, and wherein the drill bit comprises exterior cutting elements and interior fluid diverters;

the apparatus further comprising a plurality of hosing systems, a first hosing system for supplying pressurized hydraulic fluid to the hydraulic cylinders; a second hosing system to provide pressurized hydraulic fluid to each PTO of the drill assemblies; and a third hosing system for supplying pressurized water with or without an additive to each of the drill assemblies.

2. The drilling apparatus of claim 1, further comprising a plurality of flow dividers provided with one or more of the hosing systems to divert fluid flow to each of the drill assemblies or the hydraulic cylinders, as applicable.

3. The drilling apparatus of claim 1, further comprising a flow divider provided with the second hosing system, the flow divider allocating differing volumes of pressurized hydraulic fluid among the drill assemblies as each corresponding drill rod and drill bit encounters different soil compaction or conditions, thereby directly affecting the torque supplied to each of the drill rods, seeking to equalize shaft bore rates among the drill rods.

4. The drilling apparatus of claim 3, further comprising a pressure regulator coupled with the flow divider of the second hosing system to limit the maximum torque applied to the drill rods.

5. The drilling apparatus of claim 1, further comprising a return manifold which receives hydraulic fluid from each of the PTOs.

6. The drilling apparatus of claim 1, wherein the top support beam is flexibly coupled with the mast assembly by means of a first pair of chains, each chain of the first pair of chains being affixed at one end to the top support beam, being supported about a top sprocket gear affixed to the mast assembly, and being affixed at a second end to the frame, such that the top support beam is not rigidly affixed to the mast assembly or the frame, and is generally positioned with a length of the top support beam horizontal to a ground surface while capable of angling away from said horizontal position to accommodate varying bore rates among the drill rods in operation.

7. The drilling apparatus of claim 6, wherein the mid support beam is flexibly coupled with the top support beam by means of a second pair of chains, each chain of the second pair of chains being affixed at one end to the top support beam, being supported about a mid sprocket gear affixed to the mid support beam, and being affixed at a second end to the frame, such that the mid support beam is not rigidly affixed to either the mast assembly or the top support beam, and is generally positioned with a length of the mid support beam horizontal to a ground surface while capable of angling away from said horizontal position to accommodate varying bore rates among the drill rods in operation.

8. The drilling apparatus of claim 1, further comprising a high flow hydraulic filtering system to filter water prior to supply of water to the drill assembly.

9. The drilling apparatus of claim 1, wherein the drill assemblies are constructed out of chromium-molybdenum steel.

10. The drilling apparatus of claim 1, wherein the base beam comprises a pair of feet affixed to the underside thereof to stabilize the apparatus in operation and facilitate transport of the drilling apparatus.

11. The drilling apparatus of claim 1, wherein each of the hydraulic cylinders is affixed to the top mast beam by means of a rotating bushing.

12. A method of drilling into a ground surface, the method comprising the steps of:

providing a drilling apparatus comprising a mast assembly, a support structure assembly flexibly coupled with the mast assembly, a plurality of drill assemblies affixed to the support structure assembly, and a frame, wherein each of the drill assemblies comprises a hollow drill rod with a drill bit at one end, and wherein the drill bit comprises exterior cutting elements and interior fluid diverters;

supplying pressurized fluid and torque to the drill rods, and moving the drill rods downward to create a downward force so that using the downward force, the supplied torque and pressurized fluid cause the drill bits to drill into the ground surface.

13. The method of claim 12, wherein the pressurized fluid supplied to the drill rods comprises water and an additive.

14. The method of claim 12, wherein the downward movement of the drill rods corresponds with the downward movement of the mast assembly and the support structure assembly.

15. The method of claim 14, wherein the support structure assembly comprises a top support beam and a mid support beam, and wherein the support structure assembly is flexibly coupled with the mast assembly such that the support structure assembly moves vertically with the mast assembly.

16. The method of claim 15, wherein each of the plurality of drill assemblies further comprise a gearbox secured to a first facing side of the top support beam and a hydraulic power take off (PTO) coupled with and secured to the gearbox such that an output gear of the PTO supplies torque to said gearbox and said gearbox amplifies the torque, and wherein each of the hollow drill rods is secured to the corresponding gearbox.

17. The method of claim 16, wherein the drilling apparatus further comprises a flow divider and a hosing system to supply hydraulic fluid to each of the PTOs, which flow divider allocates differing volumes of pressurized hydraulic fluid among the drill assemblies as each corresponding drill rod encounters different soil compaction or conditions, thereby directly affecting the torque supplied to each of the drill rods, resulting in equalized shaft bore rates among the drill rods.

18. The method of claim 15, wherein the vertical movement of the mast assembly is provided by a pair of hydraulic cylinders.

19. The method of claim 15, wherein the top support beam is flexibly coupled with the mast assembly by means of a first pair of chains, each chain of the first pair of chains being affixed at one end to the top support beam, being supported about a top sprocket gear affixed to the mast assembly, and being affixed at a second end to the frame, such that the top support beam is not rigidly affixed to the mast assembly or the frame, and is generally positioned with a length of the top support beam horizontal to a ground surface while capable of angling away from said horizontal position to accommodate varying bore rates among the drill rods in operation; and wherein the mid support beam is flexibly coupled with the top support beam by means of a second pair of chains, each chain of the second pair of chains being affixed at one end to the top support beam, being supported about a mid sprocket gear affixed to the mid support beam, and being affixed at a second end to the frame, such that the mid support beam is not rigidly affixed to either the mast assembly or the top support beam, and is generally positioned with a length of the mid support beam horizontal to a ground surface while capable of angling away from said horizontal position to accommodate varying bore rates among the drill rods in operation.

20. The method of claim 12, wherein the drilling apparatus is removably coupled with a skid steer.

* * * * *